US006594851B2

(12) United States Patent
Sprague

(10) Patent No.: US 6,594,851 B2
(45) Date of Patent: Jul. 22, 2003

(54) GOLF BALL CLEANING DEVICE

(76) Inventor: Edwin J. Sprague, 2009 Elmwood Ave., Sharon Hill, PA (US) 19079

( * ) Notice: Subject to any disclaimer, the term of this patent is extended or adjusted under 35 U.S.C. 154(b) by 0 days.

(21) Appl. No.: 09/818,932

(22) Filed: Mar. 28, 2001

(65) Prior Publication Data

US 2002/0138932 A1 Oct. 3, 2002

(51) Int. Cl.[7] ..... A47L 25/00; A63B 57/00
(52) U.S. Cl. ..... 15/210.1; 015/104.93
(58) Field of Search ..... 015/210.1, 214, 015/218.1, 104.93, 104.94, 209.1, 208, 244.1

(56) References Cited

U.S. PATENT DOCUMENTS

| | | | | | |
|---|---|---|---|---|---|
| 968,924 | A | * | 8/1910 | Enge | 15/210.1 |
| 2,968,825 | A | | 1/1961 | Wetherby | |
| 3,426,815 | A | | 2/1969 | Ashlin et al. | |
| 3,608,708 | A | * | 9/1971 | Storandt | 15/104.94 |
| 3,750,219 | A | | 8/1973 | MacConnell | |
| 3,806,983 | A | | 4/1974 | Cunningham et al. | |
| 3,938,570 | A | | 2/1976 | Stewart | |
| 4,516,616 | A | | 5/1985 | Fesler | |
| 4,683,603 | A | | 8/1987 | Purlia et al. | |
| 4,959,881 | A | * | 10/1990 | Murray | 15/104.94 |
| 5,131,112 | A | | 7/1992 | Cervini | |
| 5,146,968 | A | | 9/1992 | Meek | |
| 5,322,105 | A | | 6/1994 | Meek | |
| 5,639,532 | A | * | 6/1997 | Wells | 15/209.1 |
| 5,704,088 | A | * | 1/1998 | Cerroni | 15/218.1 |
| 5,724,698 | A | | 3/1998 | Mondragon | |
| 5,797,142 | A | | 8/1998 | Debronsky, Jr. et al. | |
| 5,893,190 | A | | 4/1999 | Mertz | |
| 5,898,968 | A | | 5/1999 | Beattie | |
| 5,939,167 | A | | 8/1999 | Holmes | |
| 6,036,386 | A | | 3/2000 | McDonald | |
| 6,076,224 | A | * | 6/2000 | Pacifico et al. | 15/210.1 |
| 6,148,464 | A | | 11/2000 | Shioda | |
| 6,226,827 | B1 | * | 5/2001 | English, Jr. | 15/118 |
| 6,233,774 | B1 | | 5/2001 | Vogt | |

FOREIGN PATENT DOCUMENTS

| | | | |
|---|---|---|---|
| FR | 964095 | * | 2/1951 |
| GB | 2 277 273 | | 10/1994 |

* cited by examiner

*Primary Examiner*—Gary K. Graham
(74) *Attorney, Agent, or Firm*—Venable; John P. Shannon; Chad C. Anderson

(57) ABSTRACT

A golf ball cleaning device includes opposing panels joined by a hinge. The panels have a layer of a waterproof material defining an edge, a layer of a water absorbent material defining a perimeter and being affixed to the waterproof material of at least one of the panels, and a margin of waterproof material extending between the perimeter of the layer of water absorbent material and the edge of the layer of the waterproof material to which the water absorbent material is affixed. The golf ball cleaning device has a closed position in which the opposing panels contact one another, with the water absorbent material positioned between the layers of waterproof material. The margin of waterproof material prevents moisture in the water absorbent material from wicking out of the golf ball cleaning device.

6 Claims, 1 Drawing Sheet

GOLF BALL CLEANING DEVICE

BACKGROUND OF THE INVENTION

1. Field of the Invention

The invention relates to a device for cleaning a golf ball. More particularly, the invention relates to a golf ball cleaning device that can retain moisture and be carried in the pocket of a golfer between uses.

2. Background of the Invention

Players, when participating in the game of golf, frequently find it desirable to remove dirt and other foreign objects from their golf balls for any one of a number of reasons, including maintaining the flight characteristics of a golf ball. Even more significant is the necessity of cleaning a ball before putting it on a green, because irregularities on the ball can cause the ball to deviate from its path towards the hole. It some instances, golf ball cleaning devices have been provided at various locations on the golf course for use by the player when in the vicinity of the device. There are, however, many circumstances in which a player finds it inconvenient or impossible to make use of these devices. For example, most golf ball cleaning devices provided by golf courses are located near the tee areas of each hole. Once a golfer tees off, the cleaning devices are a considerable and inconvenient distance from the golfer. In some instances, less sophisticated golf courses do not offer golf ball cleaning devices at all. As a result, some golfers carry towels or rags around with them to clean their golf balls. However, rags carried by the golfer are unable to retain the moisture necessary to clean the golf ball, or golfers are unwilling to transport a moist rag through a round of golf. Other devices used to clean golf balls are too large to conveniently carry in a golfer's pocket.

SUMMARY OF THE INVENTION

An object of the present invention is to provide a compact, inexpensive, and effective golf ball cleaning device.

Another object of the invention is to provide a golf ball cleaning device that retains moisture and can be carried in a golfer's pocket without seeping moisture into the golfer's pants.

The golf ball cleaning device of the present invention achieves these and other objects by providing two thin, flat, highly flexible panels of waterproof material connected at one end by a connection that allows the panels to move away from and toward one another to open and close. An absorbent material having some roughness lines the sides of the two waterproof panels facing one another. A margin of waterproof material is provided around the perimeter of the absorbent material to seal the device closed when the sides are held together. The high flexibility of the waterproof material assures that the two panels, including the margins, are held together by the same forces of clothing against a player's body that tend to keep pockets flat.

BRIEF DESCRIPTION OF THE DRAWINGS

Embodiments of the invention are explained in greater detail by way of the drawings, where the same reference numerals refer to the same features.

DETAILED DESCRIPTION OF THE PREFERRED EMBODIMENT

Figure 1:
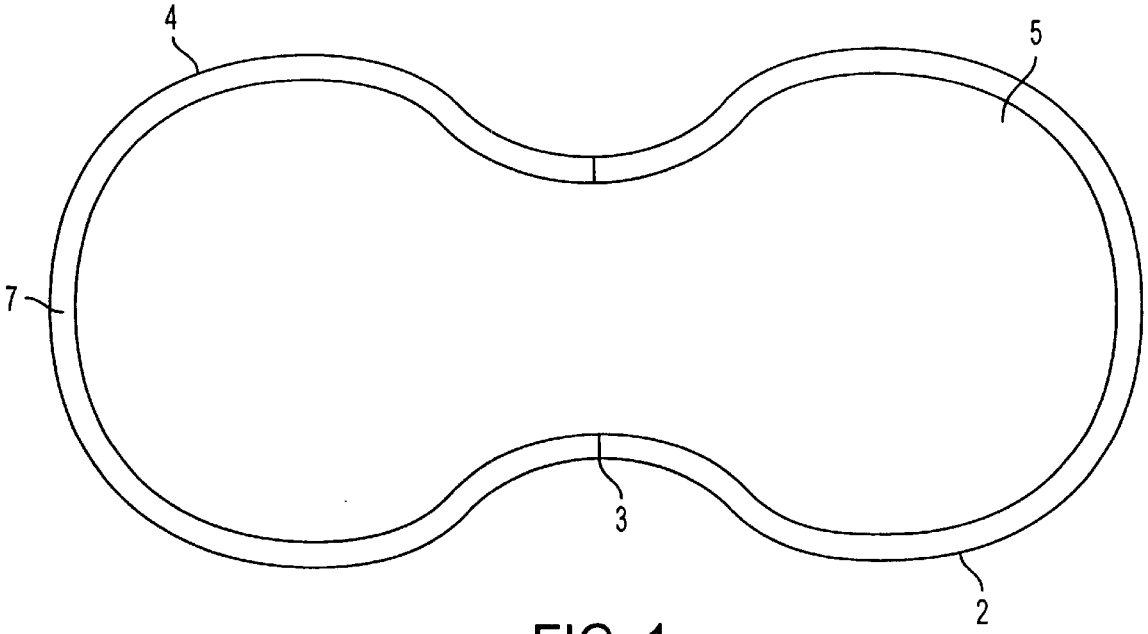
FIG. 1 is a plan view of the inner surface of the golf ball cleaning device of the present invention in an open position.

As can be seen from FIG. 1, the inner surface of a golf ball cleaning device 1 of the present invention includes a water absorbent material 5 lining the inside of each of two waterproof panels 2, 4 that are connected by a hinge 3. The waterproof panels 2, 4 have the same size and shape as one another. Almost any absorbent material can be used, including cotton. The material can be woven, knit, flocked or have other configurations. Water absorbent paper can be used as an alternative. The inner lining of water absorbent material 5 can be affixed to the inner surface of the outer panels 2, 4 by gluing or bonding. The panels 2, 4 can be made of any waterproof material having pliability and sufficient strength, when being very thin, to hold up to numerous wipings of golf balls and club heads and to the motion of a golfer's pocket through at least one round of golf. Among suitable materials are thermoplastics and coated papers or cardboards. It will be apparent that some absorbent material and some panel materials will be more durable than others. Thus, golf ball devices 1 made of some of the less durable materials may be best suited to be disposed of after a single round of golf.

A margin 7 of nonabsorbent waterproof material is provided all around the perimeter of the water absorbent material 5, between that perimeter and the edge of waterproof panels 2, 4. The margin 7, can consist of a portion of the inner surface of the panels 2, 4 that is devoid of the absorbent material 5. Alternatively, the absorbent material 5 can extend to the edge of the panels 2, 4 and the margin 7 can comprise a layer of waterproof material covering a marginal portion of the absorbent material adjacent to the edge 2, 4 of the panels. Still other arrangements can be used. The width of the margin 7 is great enough that the material of a pocket of a golfer's clothing does not come into contact with the absorbent material when the cleaning device 1 is in the pocket and folded in its closed position. A margin width of between about 0.1 inches and about 0.5 inches has been found to be suitable.

Figure 2:
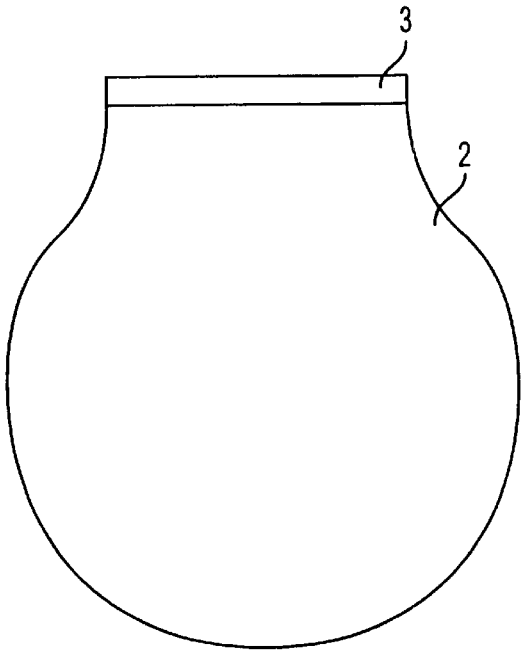
FIG. 2 is a plan view of the outer surface of the golf ball cleaning device of FIG. 1 with the panels closed.
Figure 3:
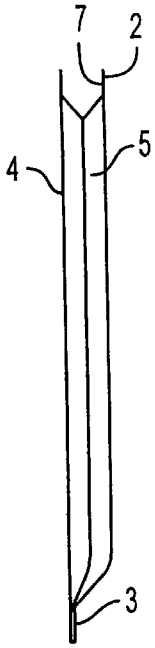
FIG. 3 is a side view of the golf ball cleaning device of FIG. 1 with the panels closed.

As can be seen from FIGS. 2 and 3, the panels 2, 4 close about a hinge 3, with panel 2 directly on top of panel 4. The panels 2, 4 can comprise different portions of one piece of material, or they can comprise distinct pieces that are joined at the hinge 3. In the case of one piece of material, the material can be folded over along a midline and the material at the midline permanently deformed to define the hinge 3, so that the hinge 3 tends to keep the panels 2, 4 flat against one another with the absorbent material inside. In the case of distinct pieces, the panels 2, 4 are joined together along one side such that the panels 2, 4 are held flat against one another. Where the panels 2, 4 are made of a thermoplastic, a heat sealing process can be used to form the hinge 3 regardless of whether the panels 2, 4 are made from the same piece or are distinct. Of course, other ways of providing the hinge can be used.

FIG. 3 shows the golf ball cleaning device from the side in a closed position. The panels 2, 4 are closed about the hinge 3. The margin 7 is shown extending beyond the water absorbent material 5.

In use, before a round of golf, the golfer moistens the absorbent material 5 with water or other liquid cleaning solution, closes the device 1 about the hinge 3, and places the device 1 in a pocket. The device, when closed, is of such dimensions as to easily fit within a golfer's pockets. For example, the approximately circular shape of the device shown in FIG. 2 can have a diameter of about 3.5 inches. The margin 7 of waterproof material surrounding the lining 5 on the inside of the device 1 keeps the water from wicking out onto the material of the golfer's pocket when the panels 2, 4 are closed. Typically, the width of the margin is between about 0.1 and about 0.5 inches. When a golfer desires to clean a golf ball, the golfer removes the device 1 from the pocket, opens the device 1, closes the panels 2, 4 around the golf ball, and rubs the panels 2, 4 around the golf ball to remove dirt and other foreign material. The water in the water absorbent inner material 5, 6 aids in the cleaning of the golf ball. After the golf ball has been cleaned, the player closes the panels 2, 4, and places the device 1 back in the pocket. In addition to cleaning golf balls, the device 1 is also useful for cleaning the heads of golf clubs, particularly irons and wedges. After a round of golf, the device 1 is simple and inexpensive enough to be discarded or durable enough for continued use.

Although the invention is described in detail with respect to a preferred embodiment, it will now be apparent from the foregoing to those skilled in the art that changes and modifications may be made without departing from the invention in its broader aspects, and the invention, therefore, as defined in the claims is intended to cover all such changes and modifications as fall within the true spirit of the invention. For example, although the illustrated embodiment has a generally circular shape, with a straight edge at the hinge, many other shapes can be used instead.

I claim:

1. A golf ball cleaning device comprising:

opposing panels joined by a hinge, said panels comprising a layer of a waterproof material defining an edge on each of the panels, a layer of a water absorbent material defining a perimeter and being affixed to the waterproof material of at least one of the panels, and a margin of waterproof material extending between the perimeter of the layer of water absorbent material and the edge of the layer of the waterproof material to which the water absorbent material is affixed, wherein the hinge extends along the edge of each of the layers of waterproof material and comprises portions of the panels being held flat against one another, and wherein the golf ball cleaning device has a closed position in which the opposing panels contact one another, with the water absorbent material positioned between the layers of waterproof material, whereby the margin of waterproof material prevents moisture in the water absorbent material from wicking out of the golf ball cleaning device.

2. The golf ball cleaning device of claim 1, wherein the margin of waterproof material has a margin of about 0.1 inches to about 0.5 inches.

3. The golf ball cleaning device of claim 1, wherein a layer of water absorbent material is affixed to each of the panels.

4. The golf ball cleaning device of claim 1, wherein the waterproof material is pliable.

5. The golf ball cleaning device of claim 1, wherein the device is sized to fit in a pocket of a golfer's clothing.

6. A golf ball cleaning device comprising:

opposing panels joined by a hinge, said panels comprising a layer of a waterproof material defining an edge on each of the panels, a layer of a water absorbent material defining a perimeter and being affixed to the waterproof material of at least one of the panels, and a margin of waterproof material extending between the perimeter of the layer of water absorbent material and the edge of the layer of the waterproof material to which the water absorbent material is affixed, wherein the hinge comprises portions of the panels being held flat against one another, wherein the golf ball cleaning device has a closed position in which the opposing panels contact one another, with the water absorbent material positioned between the layers of waterproof material, whereby the margin of waterproof material prevents moisture in the water absorbent material from wicking out of the golf ball cleaning device, wherein said margin of waterproof material, apart from said hinge, is free from means from attachment to the opposing panel; and wherein a layer of water absorbent material is affixed to each of the panels.

* * * * *